US006987524B2

(12) United States Patent
Burdenko

(10) Patent No.: US 6,987,524 B2
(45) Date of Patent: Jan. 17, 2006

(54) THERMAL PRINTER ASSEMBLY

(75) Inventor: Michael N. Burdenko, Wellesley, MA (US)

(73) Assignee: Polaroid Corporation, Waltham, MA (US)

( * ) Notice: Subject to any disclaimer, the term of this patent is extended or adjusted under 35 U.S.C. 154(b) by 15 days.

(21) Appl. No.: 10/743,631

(22) Filed: Dec. 22, 2003

(65) Prior Publication Data

US 2004/0135872 A1 Jul. 15, 2004

Related U.S. Application Data

(60) Provisional application No. 60/436,168, filed on Dec. 23, 2002.

(51) Int. Cl.
*B41J 15/00* (2006.01)

(52) U.S. Cl. ..... 347/219

(58) Field of Classification Search ..... 347/219, 347/220

See application file for complete search history.

(56) References Cited

U.S. PATENT DOCUMENTS 4,598,300 A 7/1986 Ono ..... 346/76 PH

FOREIGN PATENT DOCUMENTS

| | | | |
|---|---|---|---|
| DE | 3642715 | | 6/1988 |
| JP | 61003765 | | 1/1986 |
| JP | 62211173 | | 9/1987 |
| JP | 01-031663 | * | 2/1989 |
| JP | 01042264 | | 2/1989 |
| JP | 01159280 | | 6/1989 |
| JP | 02-24176 | * | 1/1990 |
| JP | 2001-071569 | * | 3/2001 |
| JP | 2001199095 | | 7/2001 |

* cited by examiner

*Primary Examiner*—Huan Tran

(57) ABSTRACT

There is described a thermal printer assembly which includes an elongated thermal print head oriented substantially orthogonally to a print media path and a platen roller, aligned with and opposed to the elongated thermal print head, and adapted to pressure the print media against the print head. The assembly may include one or more additional print heads.

11 Claims, 2 Drawing Sheets

THERMAL PRINTER ASSEMBLY

REFERENCE TO RELATED APPLICATIONS

This application claims the benefit of provisional application Ser. No. 60/436,168, filed Dec. 23, 2002.

TECHNICAL FIELD

The present invention relates to thermal printer assemblies and particularly to the curved path of print media through such assemblies.

BACKGROUND OF THE INVENTION

Platen rollers are commonly used in linear or serial printing to provide a firm foundation for various forms of print heads. In thermal printers, platen rollers are used for squeezing print media against a thermal print head to provide proper thermal conduction between the print head and media. Platen rollers also allow accurate movement of print media due to minimal friction characteristics. Certain types of thermal print heads are restricted to using a maximum radius platen roller, thus requiring a certain roller wrap and curvature to the print media. Unfortunately, the curvature introduced into the print media path by a platen roller can create design challenges for printer mechanisms which use multiple print heads, because this curvature is cumulative. The pulling of print media through such a distorted path presents even more design challenges for the apparatus.

SUMMARY OF THE INVENTION

The present invention relates to a thermal printer assembly for use with pulled print media, including an elongated thermal print head oriented substantially orthogonally to a print media path, and a platen roller aligned with and opposed to the elongated thermal print head and adapted to pressure print media against the print head. The platen roller defines a curvature to the print media path, and a second roller is located adjacent and substantially parallel to the print head and adapted to correct at least a portion of the curvature of the print media path for providing a more linear overall print media path.

The thermal printer assembly may include a third roller located adjacent and substantially parallel to the print head and adapted to further correct the curvature of the print media path. The second and third rollers may be located adjacent to opposing elongated sides of the thermal print head and they may be fixedly mounted.

One of the print head and the platen roller may be fixedly mounted and the other may be moveably biased. Also, the second roller may be a second platen roller, and the assembly may further include a second print head mounted adjacent to the first platen roller and aligned with the second platen roller. The first and second print heads may be adapted to print on opposing sides of the print media and across the print media path.

The first and second print heads may form a first print head assembly, and the overall assembly may further include a second print head assembly oriented to print across the print media path. The first and second thermal print heads of each print head assembly may be located sequentially along the print media path, and the first and second print head assemblies may be adjacently located sequentially along the print media path. A last sequentially located platen roller of a first sequentially located print head assembly may be adapted to bend the print media path in one direction, while a first sequential platen roller of an adjacent next sequential print head assembly is adapted to bend the print media path opposite to the one direction.

This print head assembly provides a very efficient arrangement of print heads and their respective platen rollers and substantially eliminates overall curvature of the print media path. This arrangement can perform single or double sided printing across a print media path that may be less than, equal to or wider than the elongated direction of the individual print heads. The linear efficiency of this arrangement minimizes the unprintable space which occurs at the tops of individual print media pages.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
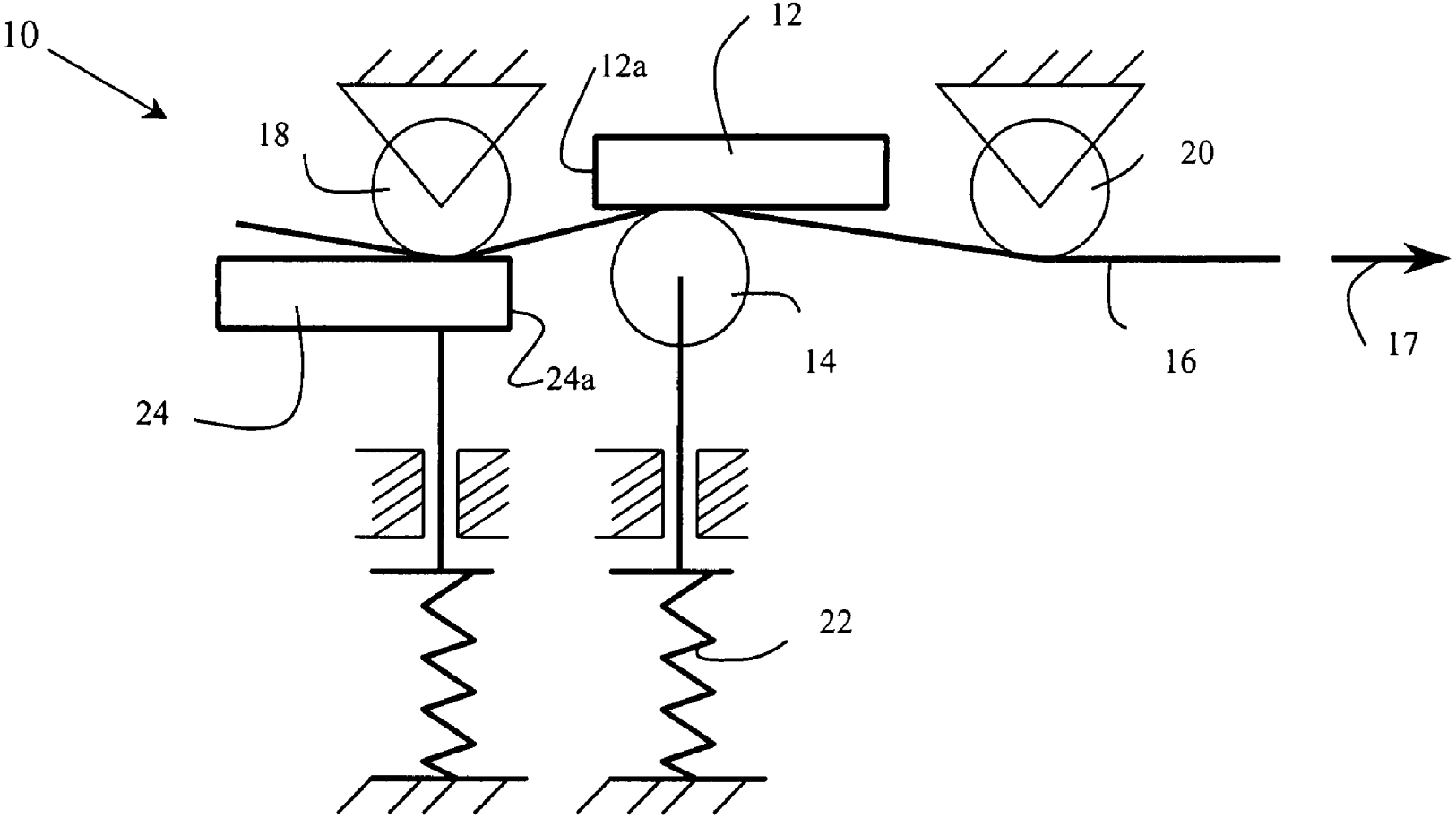
FIG. 1 is a side view diagram of one embodiment of a thermal print head assembly according to the invention.

FIG. 1 is a side view block diagram of a thermal printer assembly 10 which generally includes a thermal print head 12 and a platen roller 14. A section of print media 16 is physically biased by roller 14 against print head 12 as it travels along a print media path 17 (represented by an arrow). As mentioned, the necessity of biasing print media 16 with roller 14 necessarily causes a curvature in the print media path, which curvature appears in the downward direction for roller 14. Also included is a second roller 18 which is located adjacent to print head 12 and substantially parallel to platen roller 14. It should be understood with respect to FIG. 1 that thermal print head 12 and rollers 14 and 18 are elongated in the direction perpendicular to the plane of the diagram. Print media path 17 likewise has a width which extends orthogonal into the plane of FIG. 1. In this manner, print head 12 and rollers 14 and 18 are oriented substantially across print media path 17. The location of second roller 18 on the opposite side of the print media path from platen roller 14, causes the path of print media 16 to curve in the opposite direction from the curvature caused by platen roller 14.

Also shown is a roller 20, which is also located adjacent to print head 14 and substantially orthogonal across the path of print media 16. Because roller 20 is likewise located opposite and substantially parallel to platen roller 14, roller 20 also induces curvature into the path of print media 16 which curvature further corrects the curvature introduced by platen roller 14.

In FIG. 1, print head 12 is represented as being fixedly mounted and platen roller 14 is represented as being movably mounted and biased towards print head 12 by a spring mechanism 22. In other applications, the types of mounting may be respectively reversed so long as one of the print head or platen roller is movably biased for pressuring print media 16 against the other. Any suitable form of mounting may also be used for rollers 18, 20 and their respective mountings may be similar or different.

In a further refinement of the assembly 10, a second print head 24 is shown opposed to second roller 18. Second print head 24 is shown to be movably mounted as discussed above. In this arrangement, second roller 18 is provided in the form of a second platen roller and second print head 24 is aligned therewith. Whereas non platen rollers such as roller 20 may be provided in any suitable form, platen rollers typically include an outer rubber surface to better pressure print media uniformly against their respective print heads.

Although the assembly 10 has been illustrated with print heads 12 and 24 on opposite sides of print media 16, it will be understood that both print heads can be mounted on the same side of the print media.

Figure 2:
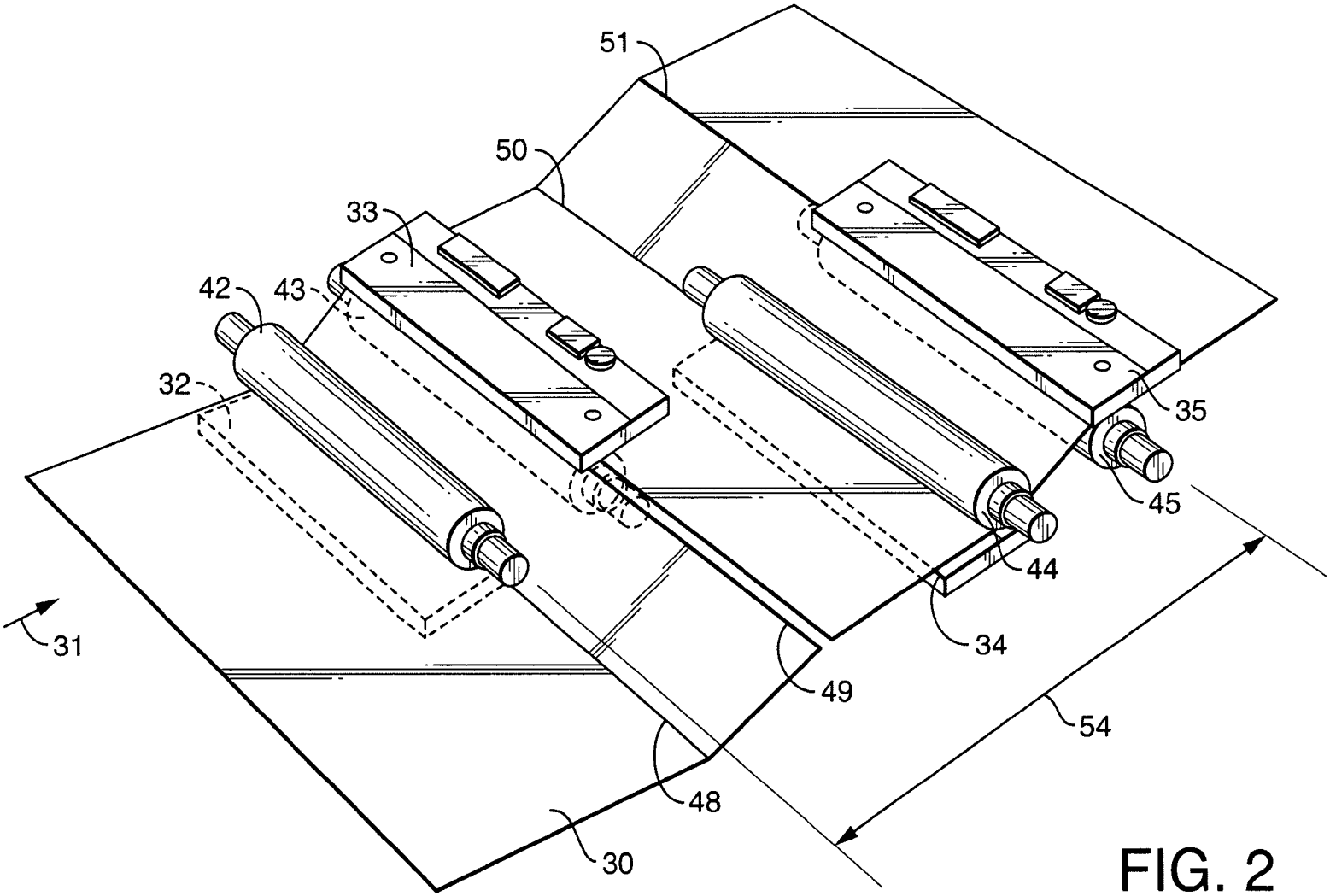
FIG. 2 is a perspective diagram of one embodiment of a multiple print head assembly according to the invention.

FIG. 2 shows a perspective view of a multiplicity of print heads and platen rollers serially located along the path of a section of print media 30. Print heads 32, 34 are shown to be sequentially located on the bottom side of print media 30, and print heads 33, 35 are shown to be sequentially interdigitated with the first print heads 32, 34, except for their being located on the top side of the path of print media 30. Each print head 32–35 is shown to have a respective platen roller 42–45 located for pressuring print media 30 against the respective print head. A multiplicity of lines 48–51 are shown crossing print media 30 and are intended to represent bends in the curvature of print media 30.

Although the print heads 32–35 are illustrated as being staggered across the print media path, it will be understood that the print heads can be arranged in any positioning such as, for example, two or more of the print heads can be located in line with each other.

By the arrangement shown in FIG. 2, print heads 32 and 33 are located sequentially along the path of print media 30 and are adjacently located. Likewise print heads 34 and 35 are sequentially and adjacently located along the path of print media 30. In this manner, print heads 32 and 33 and their respective platen rollers 42 and 43 represent a first print head assembly and print heads 34 and 35 and their respective platen and rollers 44 and 45 represent a second print head assembly. It is also appreciated that the last sequentially located platen roller 43 of the first sequentially located print head assembly is adapted to bend print media in one direction (generally downward as shown) and the first sequential platen roller 44 of the adjacent next sequential print head assembly is adapted to bend the print media 30 opposite to the one direction (generally upwardly as shown). Further, in the embodiment illustrated, the first and second print head assemblies are located across substantially different lateral portions of print media path 31.

In the manner described, the print head assembly of the present invention provides a very efficient arrangement of print heads and their respective platen rollers and eliminates overall curvature of the print media path. This particular arrangement performs double sided printing across a print media path that is wider than the elongated direction of the individual print heads. The linear efficiency of this arrangement minimizes the unprintable spaces which occur at the tops and bottoms of individual print media pages. The unprintable area is determined by the distance 54 between the first sequential print head 32 and the last sequential print head 35. Because print media path 31 is designed to eliminate the overall curvature of the print media path, print heads 32–35 are located in the closest possible proximity, thereby minimizing the unprintable area.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. A thermal printer assembly for use with pulled print media, comprising:

an elongated thermal print head oriented substantially orthogonally to a print media path;

a platen roller aligned with and opposed to said elongated thermal print head and adapted to pressure print media against said print head;

wherein said platen roller defines a curvature to said print media path;

a second roller located adjacently to said print head and orthogonal to said print media path and adapted to correct at least a portion of said curvature of said print media path; and a third roller located adjacent and parallel to said print head and adapted to further correct said curvature of said print media path.

2. The thermal printer assembly of claim 1, wherein said second and third rollers are located adjacent to opposing elongated sides of said thermal print head.

3. The thermal printer assembly of claim 2, wherein said second and third rollers are fixedly mounted.

4. The thermal printer assembly of claim 1, wherein one of said print head and said platen roller is fixedly mounted and the other of said print head and said platen roller is moveably biased.

5. A thermal printer assembly comprising:

an elongated first thermal print head oriented substantially orthogonally to a print media path;

a first platen roller aligned with and opposed to said first elongated thermal print head and adapted to pressure print media against said print head;

wherein said platen roller defines a curvature to said print media path;

a second roller located adjacently to said first print head and orthogonal to said print media path and adapted to correct at least a portion of said curvature of said print media path;

wherein said second roller is a second platen roller, and a second print head mounted parallel to and adjacent to the first said platen roller and across said print media path from said second platen roller.

6. The thermal printer assembly of claim 5, wherein said first and said second print heads are adapted to print on opposing sides of said print media across said print media path.

7. The thermal printer assembly of claim 6, wherein said first and said second print heads form a first print head assembly, and further comprising a second print head assembly oriented to print across said print media path.

8. The thermal printer assembly of claim 7, wherein said first and said second print head assemblies are located to print across substantially different portions of said print media path.

9. The thermal printer assembly of claim 7, wherein each said first and second print head assembly includes first and second thermal print heads, said first and said second thermal print heads of each print head assembly are located sequentially along said print media path, and further wherein said first and said second print head assemblies are adjacently located sequentially along said print media path.

10. The thermal printer assembly of claim 9, wherein a last sequentially located platen roller of a first sequentially located print head assembly is adapted to bend said print media path in one direction and a first sequential platen roller of an adjacent next sequential print head assembly is adapted to bend said print media path opposite to said one direction.

11. The thermal printer assembly of claim 10, wherein said first and said second print head assemblies are located to print across substantially different portions of said print media path.

* * * * *